US006340279B1

(12) United States Patent
Wipf

(10) Patent No.: US 6,340,279 B1
(45) Date of Patent: Jan. 22, 2002

(54) CONVEYOR SYSTEM WITH A FUNNEL FOR FLOWABLE BULK MATERIAL

(75) Inventor: Heinz Wipf, Niederlenz (CH)

(73) Assignee: Colortronic GmbH (DE)

( * ) Notice: Subject to any disclaimer, the term of this patent is extended or adjusted under 35 U.S.C. 154(b) by 0 days.

(21) Appl. No.: 09/479,325

(22) Filed: Jan. 6, 2000

(30) Foreign Application Priority Data

Jan. 7, 1999 (DE) ..... 199 00 176

(51) Int. Cl.[7] ..... B65G 1/00

(52) U.S. Cl. ..... 414/326; 198/548; 198/540; 222/413

(58) Field of Search ..... 198/548, 550.1, 198/550.01, 540, 547, 549; 222/413, 326, 325; 414/327

(56) References Cited

U.S. PATENT DOCUMENTS 2,799,407 A * 7/1957 Vanier et al. ..... 214/17
4,361,254 A * 11/1982 Teraoku et al. ..... 222/196
5,702,183 A * 12/1997 Rasimus et al. ..... 414/329
5,769,281 A * 6/1998 Bates ..... 222/196

OTHER PUBLICATIONS

Dissertation entitled: "On the Characteristics of Volumetric Screw Dosing Devices for Bulk Materials", by Dr. Dieter Fritsch, 1988, published G. Graebner, Dissertation and Offset Printing, Altendorff, near Bamberg, Germany, 3 pages, No Translation.

* cited by examiner

*Primary Examiner*—Donald P. Walsh
*Assistant Examiner*—Joe Dillon, Jr.

(57) ABSTRACT

A conveyor system for moving flowable bulk material is equipped with a funnel (12) that has a circular funnel inlet (13) formed by a cylindrical wall section (16') and an orthogonal funnel outlet (14) formed by eight funnel walls (18; 17, 17A; 17', 17") connected at one end to the cylindrical wall section (16') and forming at the opposite end the orthogonal funnel outlet (14). Four walls (17, 17A; 17', 17") of the eight funnel walls are flat or plane and form funnel side or lateral walls. The remaining four four walls (18) have a curved cross-section and form funnel corner walls which interconnect the funnel lateral plane walls. The eight funnel walls are substantially longer in the axial direction than the cylindrical wall section (16'). The corner walls (18) and the lateral plane walls have approximately the same axial length (H≈H'). The eight funnel walls cooperate in avoiding clogging of the bulk material as it flows through the funnel.

20 Claims, 6 Drawing Sheets

CONVEYOR SYSTEM WITH A FUNNEL FOR FLOWABLE BULK MATERIAL

PRIORITY CLAIM

This application is based on and claims the priority under 35 U.S.C. §119 of German Patent Application 199 00 176.6, filed on Jan. 7, 1999 the entire disclosure of which is incorporated herein by reference.

FIELD OF THE INVENTION

The invention relates to a conveyor system for flowable bulk material that is supplied to the conveyor system through a specially formed funnel.

BACKGROUND INFORMATION

Conveyor systems for transporting flowable bulk material are known in the art. Such systems include one or two screw conveyors rotatably mounted in a housing. The flowable bulk material, for example powders, is supplied into the conveyor housing through a funnel also known as a hopper. The funnel or hopper normally has a circular funnel inlet and an orthogonal funnel outlet leading into a housing inlet of the conveyor system. Between the funnel inlet and the funnel outlet the funnel walls are formed partially cylindrical and partially as a pyramid frustum. Additionally, the funnel wall includes crowned or cambered intermediate wall sections. The side walls of the conveyor housing are positioned partly vertically and partly slanted to form a wedge shape as a trough in which one or more conveyor screws or worms are rotatably housed.

Such hoppers or filler funnels are also described in a published Dissertation entitled: "On the Characteristics of Volumetric Screw Dosing Devices for Bulk Materials", by Dr. Dieter Fritsch, 1988, published G. Graebner, Dissertation and Offset Printing, Altendorff, near Bamberg, Germany.

The production of conventional funnels requires a substantial effort and expense. Such disadvantages have been conventionally acceptable because the free flowability of the bulk material must be assured even for bulk material that is not necessarily freely flowable and for bulk material having a tendency to build bridges in the funnel thereby causing clogging the flow through the funnel. Certain conventional conveyor systems of this type are even equipped with a stirring mechanism in the lower portion of the funnel or just above the screw conveyor in order to maintain the flowing of the bulk material.

OBJECTS OF THE INVENTION

In view of the foregoing it is the aim of the invention to achieve the following objects singly or in combination:

- to construct and orient the funnel walls in such a way that an improved flowability of the bulk material is assured even for bulk material having a hard flowing characteristic;
- to minimize the need for a stirring mechanism in the funnel or in the conveyor system while still maintaining an optimal flowability of the bulk material; and
- to shape and configure the funnel walls in such a way that the funnel manufacture is facilitated, thereby reducing the costs for these funnels or hoppers.

SUMMARY OF THE INVENTION

The above objects have been achieved according to the invention by a conveyor system for flowable bulk material, which system is characterized by a combination of the following features. The present system comprises a conveyor that is mounted in a conveyor housing provided with an upwardly facing housing inlet having four inlet edges forming together four housing inlet corners. A funnel for feeding bulk material into the conveyor housing through the housing inlet is provided with a circular funnel inlet and a funnel outlet fitting or matching the housing inlet.

The funnel walls are formed by a cylindrical wall section that surrounds the circular funnel inlet and by a total of eight wall sections, four of which form lateral plane or flat wall sections arranged in first and second pairs of lateral plane wall sections, whereby the wall sections forming a pair are positioned diametrically opposite each other. The upper ends of the plane wall sections are connected to the cylindrical wall section while the lower ends form the funnel outlet. The upper ends of the lateral wall sections are narrower than the lower ends of the lateral wall sections. The eight funnel walls further include four curved corner wall sections having a wider upper portion than a narrower lower portion so that wider and narrower wall sections alternate with each other around the funnel inlet and around the funnel outlet. The four curved corner wall sections are curved by reason of a curved cross-section in a horizontal plane. The cylindrical wall section has an axial width that is substantially smaller than an axial length of the flat or plane lateral wall sections and also substantially smaller than a longitudinal dimension of the corner wall section. The longitudinal dimension of the curved corner wall sections is approximately equal to the axial length of the lateral plane wall sections.

The meaning of the terms "approximately" and "substantially" as used herein is determined by the steepness angles $\alpha$ and $\beta$. The angle $\alpha$ is defined as the angle between a vertical line and a curved corner wall section. The angle $\beta$ is defined as the angle between the vertical and a lateral plane wall section. When $\alpha$ and $\beta$ are equal to each other and the funnel outlet is a square rather than a rectangle, the axial length of the lateral walls and the longitudinal dimension of the corner wall sections will be equal to each other. However, according to the invention it is preferred that the angle $\alpha$ is within the range of 0° to 5° and the angle $\beta$ is within the range of larger than 5° up to 15°. It has been found, that this arrangement in combination with the relative length between the curved corner wall sections and lateral plane wall sections on the one hand and the vertical width of the cylindrical wall section provides steep positions of the lateral and corner wall sections relative to the vertical to thereby positively avoid clogging of the bulk material, for example by so-called bridging of the bulk material flowing through the funnel.

The present invention is also directed to the funnel itself independently of the conveyor system. Such funnel is defined by the above outlined funnel features.

Relative to the entire axial length of the funnel according to the invention its lateral flat or plane wall sections and its curved corner wall sections extend at a slant relative to the funnel outlet which slant is substantially steeper than in known funnels. It has been discovered, that this steepness is critical to the prevention of clogging, for example by bridging of the bulk material flowing through the funnel. This steepness of the lateral wall sections and of the corner wall sections make it surprisingly possible to construct the axial length of the funnels according to the invention substantially shorter than was possible heretofore, thereby, saving sheet material for making the present funnels. Thus, the lateral flat or plane wall sections which resemble a cross-section through a pyramid frustum and the corner wall sections which have a curved cross-section in a horizontal plane and which are approximately triangular in a developed projected form, provide together with the short cylindrical inlet wall section an integrated unit which provides optimal flow characteristics for the bulk material. A shorter funnel according to the invention achieves a throughput that can be achieved by a conventional funnel only if the conventional funnel has an axial length larger than the axial length of the present funnels. Comparing a funnel according to the invention with a conventional funnel of equal size, namely of equal axial length, equal inlet cross-sectional area, and equal outlet cross-sectional area, the present lateral plane wall sections are about twice as long as conventional lateral wall sections, which is possible because the inlet cylindrical wall section of the present funnels is very short compared to the length of the lateral and corner wall sections of the present funnels. Similarly, the corner wall section having a cross-sectional curvature in a horizontal plane are several times longer and thus steeper than conventional cambered or crowned corner wall sections. The present wall sections which, due to gravity, actively guide the bulk material, are distinctly steeper than comparable wall sections of conventional funnels. As a result, the present funnels offer a substantially improved flow characteristic to the bulk material, while still assuring the required guiding of the bulk material into the conveyor housing.

The several dimensions discussed herein vary in accordance with the required cross-sectional areas of the funnel inlet and of the funnel outlet. The dimensions of the funnel outlet will depend on the housing construction and may be either rectangular or square. The cylindrical wall section of the present funnel inlet may include a flange extending radially or it may be provided with a conical collar that in turn is provided with a flange.

Although it is the purpose of the invention to generally avoid the use of a stirring mechanism, this does not exclude the use of such a stirring mechanism, for example, in connection with a bulk material having especially difficult flow characteristics.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
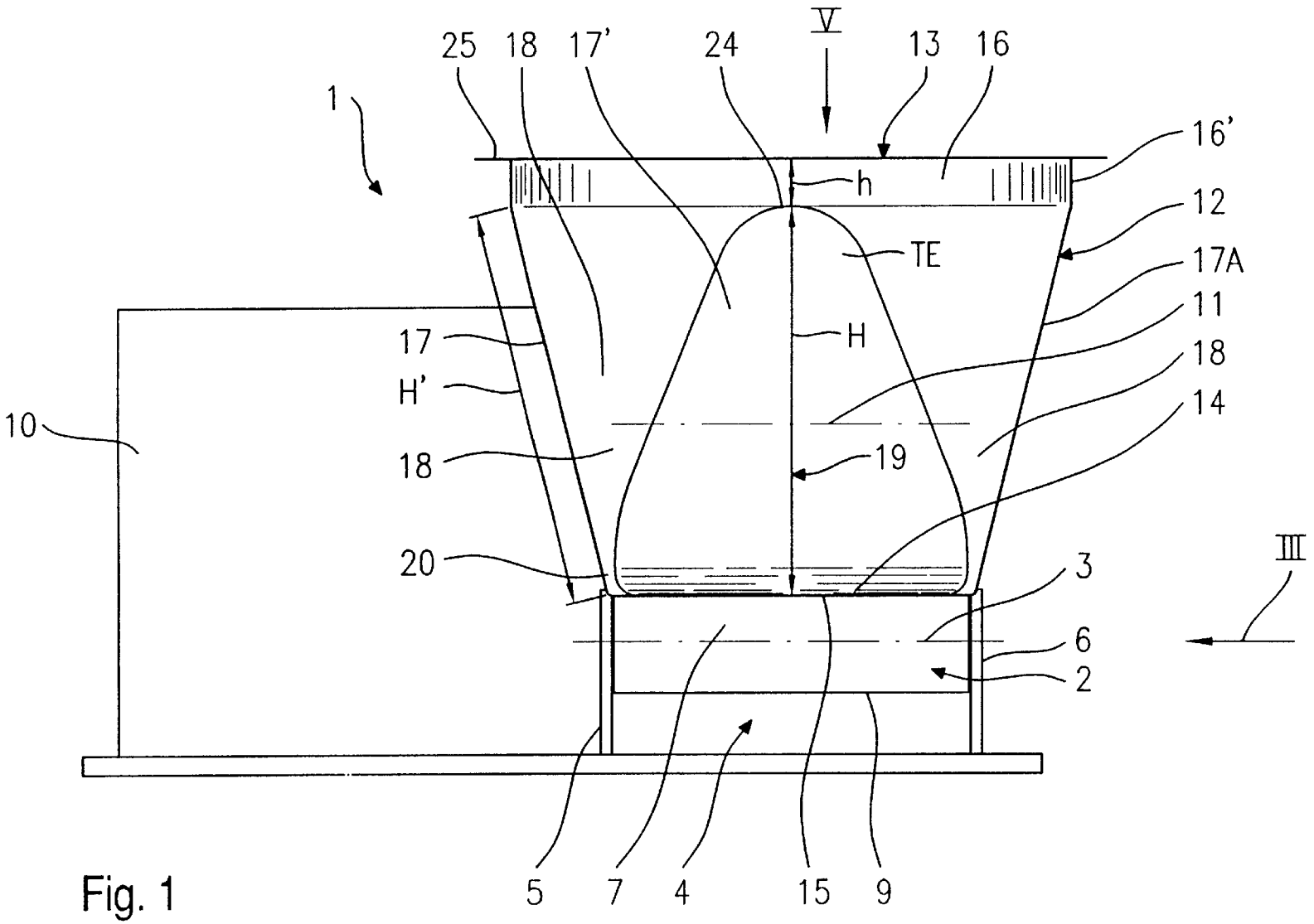
FIG. 1 is a schematic side view of a conveyor system according to the invention with a conveyor screw as the conveying element for flowable bulk materials.

FIG. 1 shows a bulk material conveyor or feeder system 1 for transporting fine grained or powderized bulk material. Such a system comprises at least one screw or worm conveyor 2 having a rotational axis 3. The screw conveyor 2, such as one or two screws, extends with the rotational axis 3 horizontally in a housing 4 formed by vertical end walls 5 and 6 and by side walls 7 and 8. The side walls 7 and 8 slant downwardly toward each other to form a trough 9 having a somewhat wedge-shaped configuration as best seen by dashed lines in FIG. 3.

Figure 2:
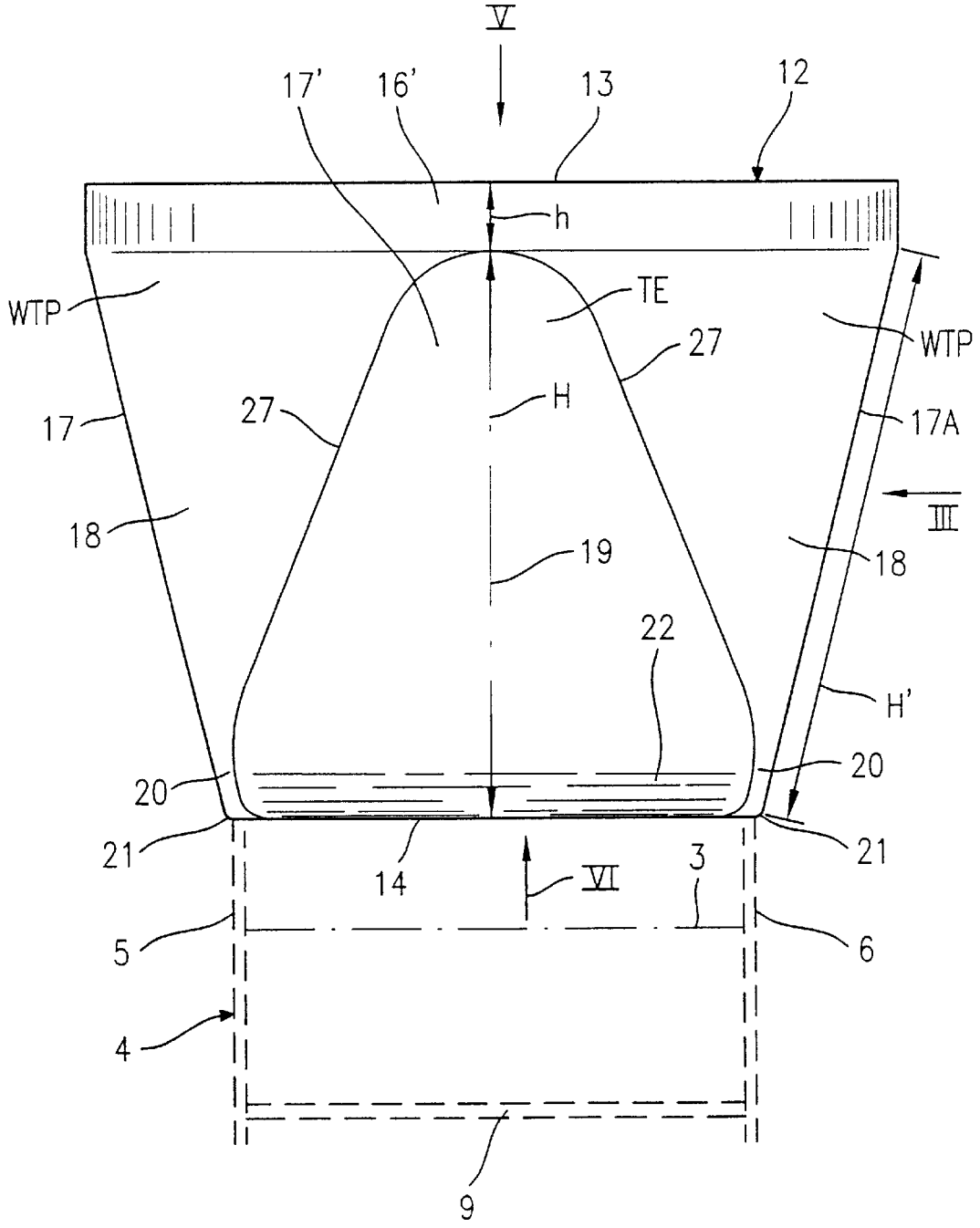
FIG. 2 is a side view as in FIG. 1, however showing only the funnel according to the invention on an enlarged scale compared to FIG. 1.
Figure 3:
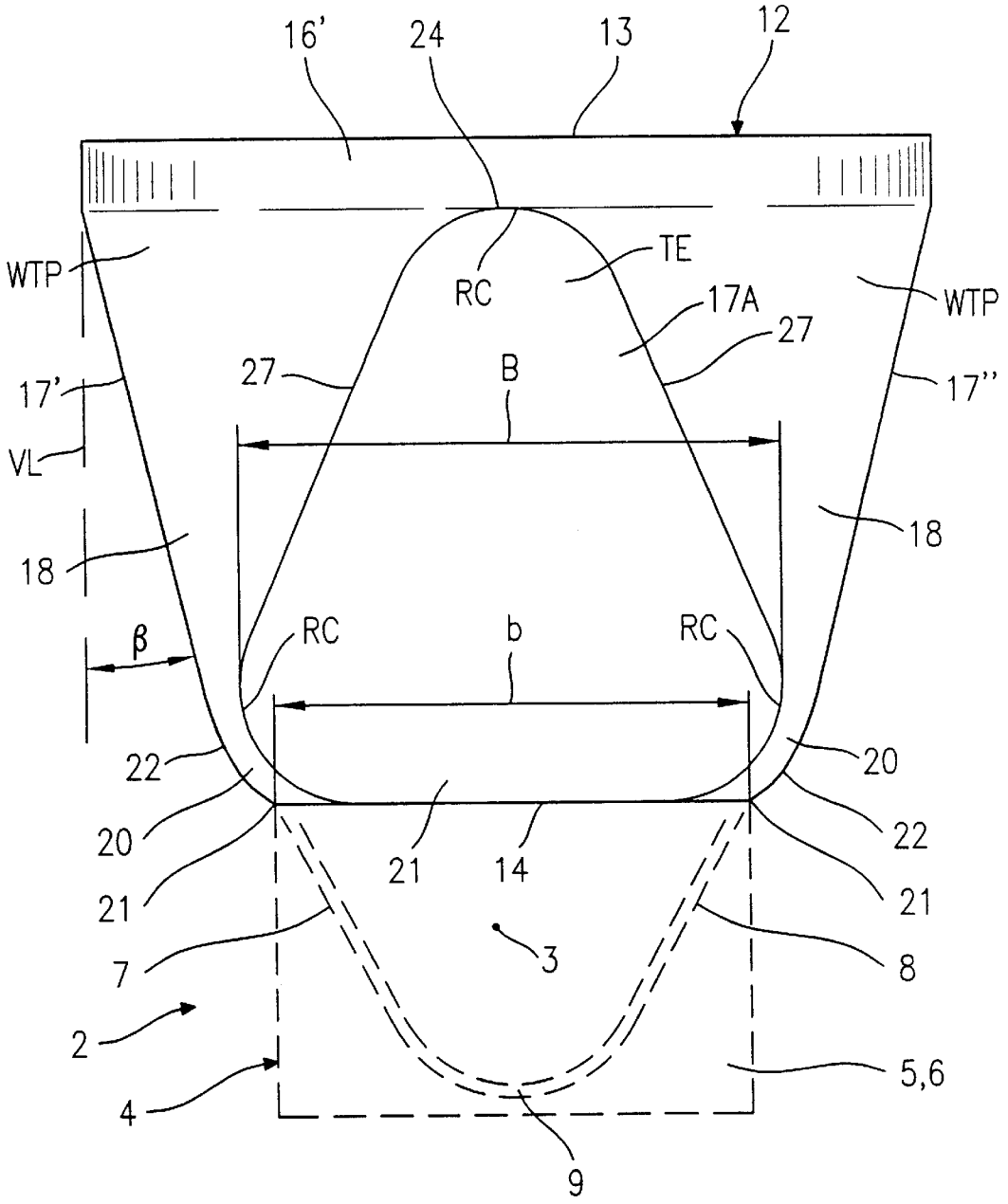
FIG. 3 is a view in the direction of the arrow III shown in FIGS. 1 and 2 pointing in the direction of the rotational axis of the conveyor screw.

FIGS. 2 and 3 show the housing 4 only in dashed lines, however on a larger scale than in FIG. 1.

A motor, not shown but mounted in a housing 10, drives the conveyor screw or screws 2, preferably through a gear transmission which may simultaneously drive a stirring device only shown symbolically by its axis 11. The just described components are conventional.

According to the invention the conveyor system is equipped with a funnel 12 positioned on the conveyor housing 4 so that a funnel outlet 14 leads the bulk material into a housing inlet 15. The longitudinal and lateral dimensions of the funnel outlet 14 and of the housing inlet 15 are defined by respective edges that correspond to one another so that the outlet 14 fits or matches the housing inlet 15. The inlet and outlet are orthogonal and preferably have a square or rectangular configuration.

Figure 5:
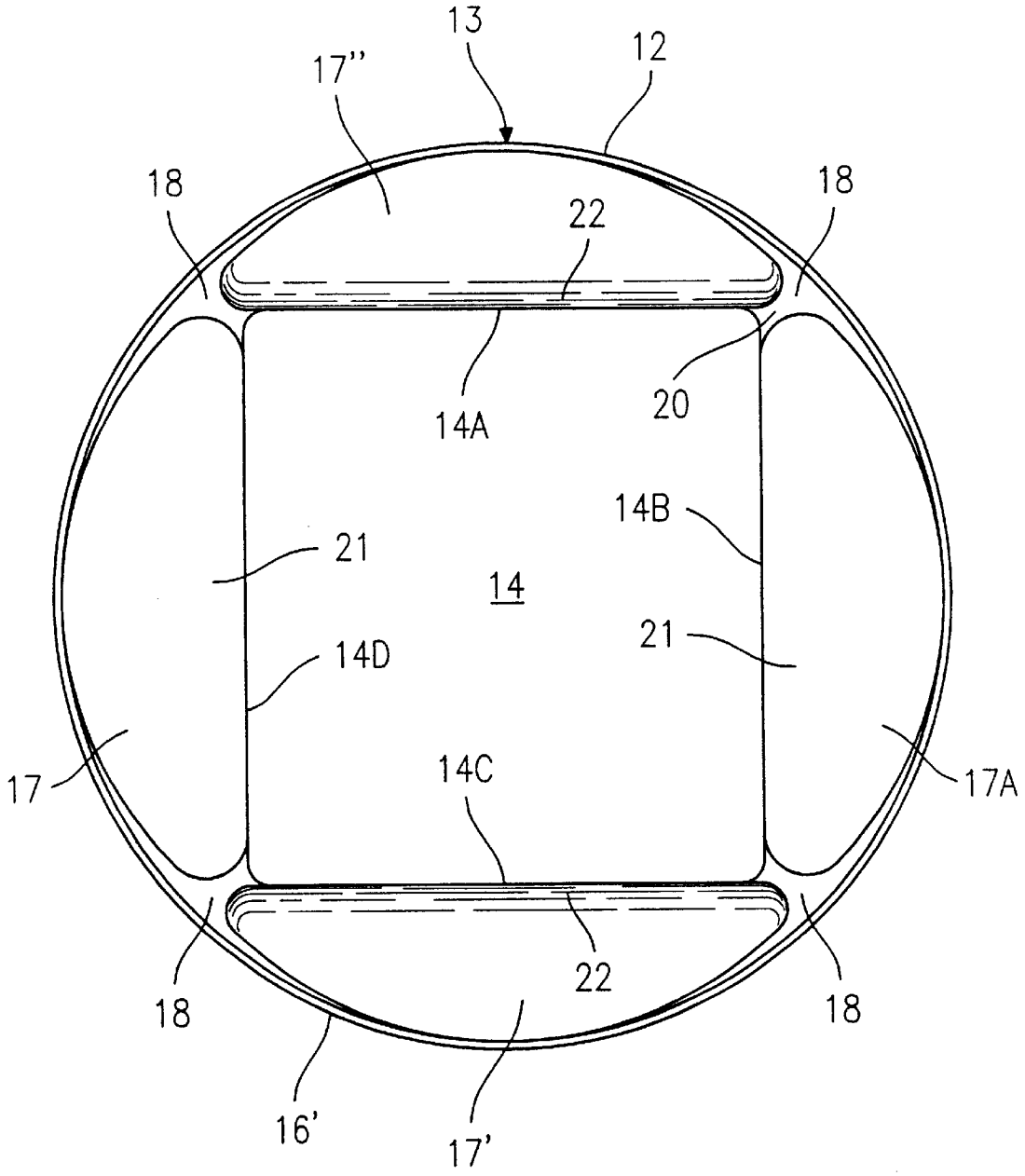
FIG. 5 is a view in the direction of the arrow V shown in FIGS. 1 and 2 into the inlet end of the present funnel.
Figure 6:
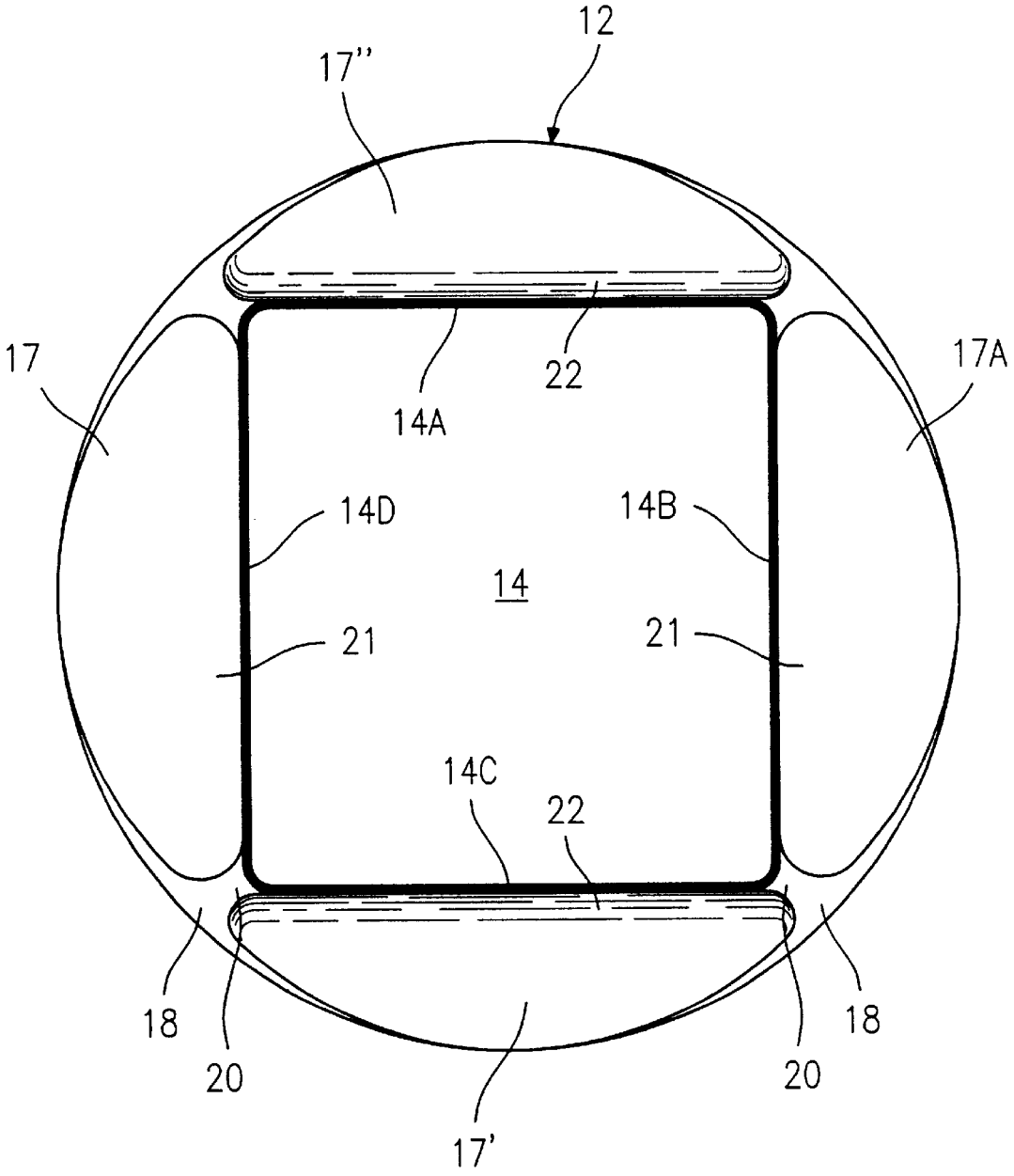
FIG. 6 is a view in the direction of the arrow VI in FIG. 2 into the outlet end of the present funnel.

The funnel 12 has a circular funnel inlet 13 at its upper end 16 formed by a cylindrical wall section 16' surrounding the circular funnel inlet 13 as best seen in FIG. 5. Between the cylindrical wall section 16' and the funnel outlet 14 the body of the funnel is formed by flat or plane side wall sections 17, 17A; and 17', 17" circumferentially interconnected by corner wall sections 18 having a curved cross-sectional configuration in a horizontal plane. The flat or plane wall sections have the configuration of a section through a pyramid frustum or of a triangle with rounded corners. The developed, projected configuration of the corner wall sections 18 is also substantially triangular, however with tipped corners.

According to the invention the cylindrical wall section 16' has an axial width h. Similarly, the lateral flat or plane wall sections 17, 17A and 17', 17" have an axial or longitudinal length H. The corner wall sections 18 have a longitudinal dimension H'. According to the invention it is critical that the axial dimension H and the longitudinal dimension H' are substantially larger than the axial width h, preferably these dimensions H and H' will be within the range of 5 to 15 times the width h. The length of the dimension H and H' will depend on the size of the angles $\alpha$ and $\beta$ as described above. The angle $\alpha$ should be preferably in the range of 0° to 5° and the angle $\beta$ should be larger than 5° up to 15° relative to a respective vertical line VL.

The resulting steepness relative to the vertical of the lateral funnel wall sections and the corner wall sections contributes to improving the flowability of the bulk material through the funnel 12.

Each corner wall section 18 has a narrow lower or bottom portion 20 that forms a flute having, for example, a trough or channel cross-sectional configuration in a horizontal plane. Including the narrow portions 20 in the dimension H' makes the corner wall sections 18 at least as long as the lateral flat or plane wall sections 17, 17A, 17', 17". The lateral plane wall sections form a first pair of wall sections 17, 17A and a second pair of plane wall sections 17', 17". The lateral plane wall sections forming a pair are positioned diametrically opposite each other and have narrow top or upper ends TE connected to the cylindrical wall section 16' at 24. The corner wall sections 18 have wide top portions WTP and the above mentioned narrow bottom portions 20 which merge or connect into the corners of the funnel outlet 14. The lateral wall sections 17 and 17A have flat, wide lower ends 21 merging or forming a respective edge 14D, 14B of the funnel outlet 14. The lateral wall sections 17' and 17" have curved wide bottom ends 22, whereby the curvature of these ends 22 preferably form a cylinder sector, the lower edge of which also merge into or forms a respective edge 14C, 14A of the funnel outlet 14. Preferably, the flat wall ends 21 connect to the housing end walls 5 and 6 of the housing 4 as best seen in FIG. 2 while the curved wall ends 22 of the lateral wall sections 17', 17" merge into the longitudinal upper wall edges of the trough forming walls 7 and 8 as best seen in FIG. 3. FIG. 3 also shows that the curvature of the wall ends 22 is very slight. In other words, the respective cylinder has a large diameter so that the respective curvature appears to be almost flat at the lower wall ends 22.

It has been found that especially good flow characteristics are imparted to the bulk material if the plane wall sections 17, 17A, 17', 17" extend substantially over the entire axial length of the funnel 12 and if additionally the wall sections 17 and 17A have a width B which is larger than the respective length b of the funnel outlet 14. Incidentally, FIG. 3 shows the funnel 12 rotated by 90° clockwise about the vertical funnel axis 19 relative to the funnel position shown in FIG. 2. The above mentioned triangular configuration of the flat or plane wall sections 17, 17A, 17', 17" has rounded corners RC as best seen in FIG. 3. The rounding at the top end TE of the lateral plane wall sections 17, 17A, 17', 17" assumes approximately the shape of a parabola having a tip 24 which is connected to the cylindrical inlet wall section 16'. On the other hand, the wide top portions WTP of the corner wall sections 18 are also connected to the cylindrical wall section 16', however along a substantially larger sector.

Figure 4:
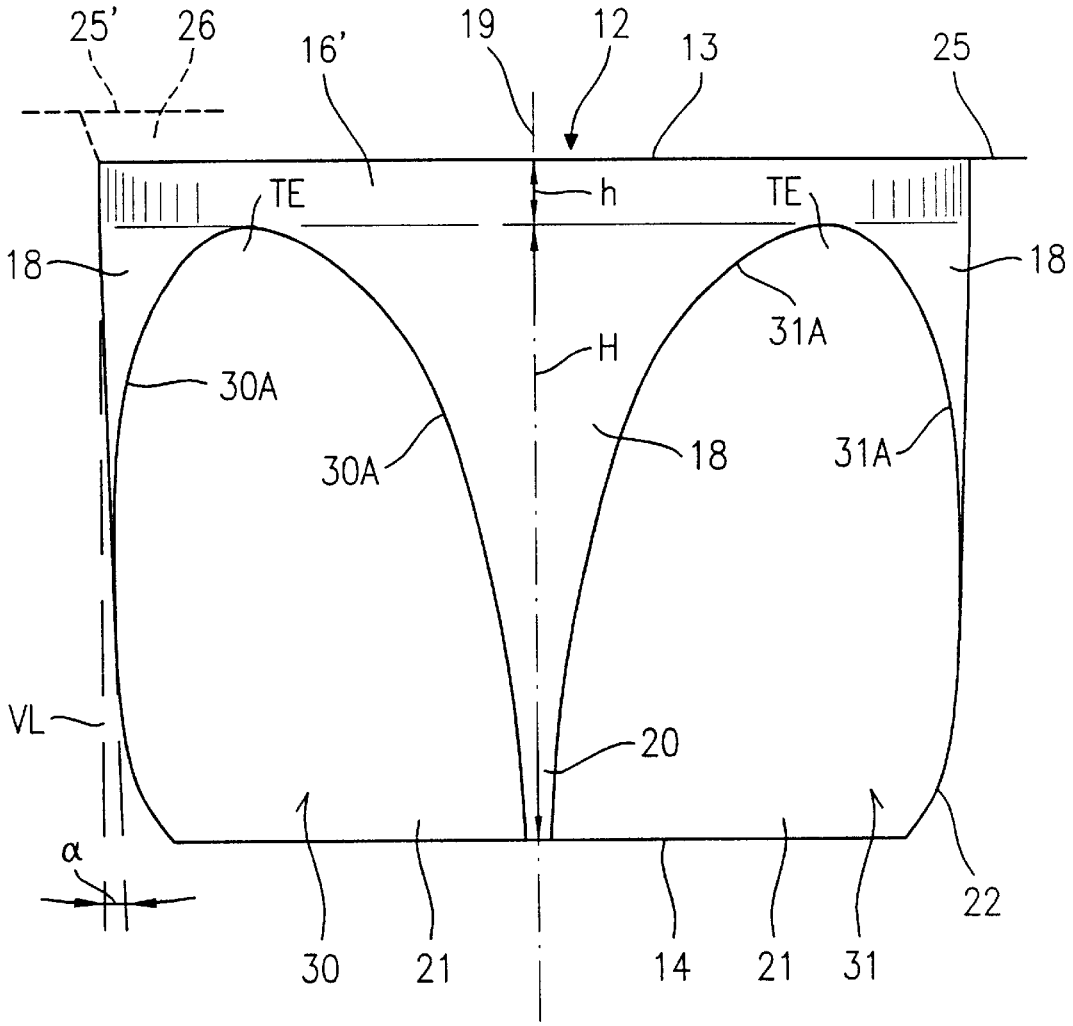
FIG. 4 shows a second embodiment of a funnel according to the invention with side walls having a modified configuration compared to the first embodiment, whereby the view is in the direction toward a corner of the funnel.

Referring further to FIG. 3, the angle β is formed between a vertical line VL and the respective plane wall section 17'. A corresponding angle is formed between the respective other plane wall sections and the vertical. Thus, these wall sections are inclined and their steepness depends on the size of the angle β. As shown in FIG. 4 a similar angle α is formed between the vertical line VL and the inclined wall surface of the curved corner wall sections 18. The flowability is enhanced according to the invention if the angle α is distinctly smaller than the angle β.

FIG. 4 further shows a flange 25 connected to the cylindrical wall section 16'. In an alternative embodiment shown in dashed lines in FIG. 4, the funnel inlet 13 may be provided with a conical wall section 26 surrounded by a flange 25'.

The embodiment of FIG. 4 further shows that the flat wall sections 30 and 31 have curved edges 30A and 31A respectively. The top ends TE are also connected to the cylindrical wall section 16'. The corner wall sections 18 and the plane wall sections 17, 17A, 17', 17", as shown in FIGS. 2 and 3 have junctions formed along straight lines 27 and along the rounded corners RC while in FIG. 4 the junctions between the plane wall sections and the corner wall sections 18 are formed along curved lines 30A, 31A.

As mentioned above, it is important that the narrow lower portions 20 of the corner wall sections 18 form a channel or trough facing inwardly so that there is a smooth transition between the corner walls 18 and the wide bottom ends 21 and 22 of the lateral plane wall sections 17, 17A, 17', 17".

The present funnels 12 are produced efficiently from sheet metal by stamping and drawing operations, whereby several deformation steps are preferably performed in sequence until the shape illustrated in the drawings is achieved. Due to the several deformation steps, it is recommended that the sheet metal material is annealed in an intermediate step between deforming steps.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A conveyor apparatus for flowable bulk material, said conveyor apparatus comprising a conveyor (2), a conveyor housing (4) for enclosing said conveyor (2), said conveyor housing (4) including an upwardly facing housing inlet (15) having four inlet edges forming together four housing inlet corners, a funnel (12) for feeding bulk material into said conveyor housing (4) through said housing inlet (15), said funnel (12) comprising a circular funnel inlet (13) and a funnel outlet (14) fitting said housing inlet (15), said funnel (12) further comprising a cylindrical wall section (16') with an axial width (h) surrounding said circular funnel inlet (13), and four lateral plane wall sections (17', 17"; 17, 17A) forming a first pair (17, 17A) and a second pair (17', 17") of lateral plane wall sections, said first and second pairs of lateral plane wall sections having upper wall ends (TE) connected to said cylindrical wall section (16"), wherein said lateral plane wall sections forming a pair are positioned diametrically opposite each other relative to a vertical funnel axis (19), said four lateral plane wall sections having lower wall ends (21, 22) wider than said upper wall ends (TE), said wider lower wall ends (21, 22) being connected to said four inlet edges of said housing inlet (15), said funnel (12) further comprising four curved corner wall sections (18), each curved corner wall section (18) having a wide upper portion (WTP) connected to said cylindrical wall section (16') and a lower portion (20) narrower than said upper corner wall portion (WTP), each of said lower narrower corner wall portions (20) being connected to one of said four housing inlet corners, wherein said four lateral wall sections (17', 17"; 17, 17A) and said four curved corner wall sections (18) are interconnected along junctions to form said funnel (12), wherein said four curved corner wall sections have a curved cross-section in a horizontal plane, wherein said lateral plane wall sections have an axial length (H) substantially longer than said axial width (h) of said cylindrical wall section (16').

2. The conveyor of claim 1, wherein each of said lower narrower corner wall portions (20) of said four curved corner wall sections (18) forms an inwardly facing flute with a channel sectional configuration.

3. The conveyor of claim 1, wherein said four lateral plane wall sections (17', 17"; 17, 17A) have a horizontal width that diminishes toward said cylindrical wall section (16') so that said four lateral plane wall sections have a substantially parabolic configuration with a curved portion (RC) next to and connected to said cylindrical wall section (at 24).

4. The conveyor of claim 1, wherein said four lateral plane wall sections (30, 31, . . . ) have curved edges (30A, 31A, . . . ) that form junctions between said four curved corner wall sections (18) and said lateral plane wall sections (30, 31, . . . ), (FIG. 4).

5. The conveyor of claim 1, wherein said four curved corner wall sections (18) enclose an angle (α) with a vertical line (VL), wherein said four lateral plane wall sections (17', 17"; 17, 17A; 30, 31, . . . ) enclose an angle (β) with a respective vertical line (VL) and wherein said angle (β) is larger than said angle (α).

6. The conveyor of claim 1, wherein said housing inlet (15) and said funnel outlet (14) have identical orthogonal cross-sectional configurations and said edges enclose an orthogon.

7. The conveyor of claim 1, wherein said orthogon is a square.

8. The conveyor of claim 1, wherein said lower wall ends (21) of said first pair of said lateral wall sections (17, 17A) are plane wall ends extending toward respective first funnel outlet edges (14B, 14D) of said four housing inlet edges, and wherein said lower wall ends (22) of said second pair of said lateral wall sections (17', 17") are curved toward respective second funnel outlet edges (14A, 14C).

9. The conveyor of claim 8, wherein said conveyor housing (4) has two housing side wall members (7, 8) slanting downwardly toward each other to form a trough (9), and two housing end wall members (5, 6) closing ends of said trough (9), wherein said plane wall ends (21) of said first pair of lateral wall sections (17, 17A) merge into said housing side wall members (7, 8), and wherein said curved wall ends (22) of said second pair of lateral wall sections (17', 17 ") merge into said housing end wall members (5, 6) of said conveyor housing (4).

10. The conveyor of claim 8, wherein each of said lateral plane wall section (17, 17A) of said first pair has a horizontal width (B) above said first funnel outlet edges (14B, 14D), wherein said first funnel outlet edges (14B, 14D) have a horizontal length (b) which is smaller than said horizontal width (B), and wherein said lateral wall sections (17, 17A) forming said first pair of lateral wall sections have rounded corners (RC) below said width (B), said rounded corners (C) reducing said width (B) toward said length (b).

11. A funnel which feeds bulk material to a conveyor, said funnel (12) comprising a circular funnel inlet (13) and orthogonal funnel outlet (14), a cylindrical wall section (16') having an axial width (h) surrounding said circular funnel inlet (13), four lateral, flat or plane wall sections (17, 17A; 17', 17") each having a narrow top end (TE) connected to said cylindrical wall section (16') and a wide bottom end (21, 22) forming said funnel outlet (14), and four curved corner wall sections (18) having a wide top portion (WTP) and a narrow bottom portion (20) also forming said funnel outlet (14), connecting juntions (27, RC, 30A, 31A) between said cylindrical wall section (16') said lateral flat wall sections (17, 17A; 17', 17") and said curved corner wall sections (18) for forming said funnel (120, wherein said lateral wall sections have an axial length (H) substantially longer than said axial width (h) of said cylindrical wall section (16'), and wherein said curved corner wall sections (18) have a longitudinal dimension (H') that is approximately equal to said axial length (H) of said lateral wall sections (17', 17"; 17, 17A).

12. The funnel of claim 11, wherein said orthogonal funnel outlet (14) has a square configuration.

13. The funnel of claim 11, wherein each of said bottom narrower corner wall portions (20) of said four curved corner wall sections (18) forms a flute with a channel sectional configuration.

14. The funnel of claim 11, wherein said connecting junctions comprise straight portions (27) and curved portions (RC, 30A, 31A).

15. The funnel of claim 11, wherein said corner wall sections (18) extend at an angle (α) relative to a vertical line (VL), wherein said lateral flat wall sections extend at an angle (β) relative to a respective vertical line (VL), and wherein said angle (α) is smaller than said angle (β) so that said corner wall sections (18) are positioned steeper relative to said vertical line than said lateral flat wall sections (17, 17A; 17', 17"), and wherein (α) is within the range of 0° to 5° and (β) is within the range of larger than 5° up to 15°.

16. The funnel of claim 11, wherein said axial length (H) and said longitudinal dimension (H') are at least five times longer than said axial width (h) and up to 15 times longer than said axial width (h) of said cylindrical wall section (16').

17. The funnel of claim 11, wherein two of said four lateral flat wall sections (17, 17A) form a first pair of lateral flat wall sections positioned diametrically opposite each other, wherein said wide bottom (21) end of said first pair of lateral flat wall sections (17, 17A) is also flat, and wherein the remaining two of said four lateral flat wall sections form a second pair of lateral flat wall sections also positioned diametrically opposite each other, wherein said wide bottom end (22) of said second pair has a curvature toward said funnel outlet (14).

18. The funnel of claim 17, wherein said curvature of said wide bottom end (22) is a sector of a cylinder jacket.

19. The funnel of claim 11, wherein said curved corner wall sections (18) have a developed projected triangular configuration with tipped corners.

20. The funnel of claim 11, wherein said lateral flat wall sections have a triangular configuration with rounded corners.

* * * * *

UNITED STATES PATENT AND TRADEMARK OFFICE

CERTIFICATE OF CORRECTION

PATENT NO. : 6,340,279 B1
DATED : January 22, 2002
INVENTOR(S) : Wipf

It is certified that error appears in the above-identified patent and that said Letters Patent is hereby corrected as shown below:

Title page,
Item [73], Assignee, after "Colortronic GmbH", insert -- , Friedrichsdorf, --.
Following Item [56] "Assistant Examiner - Joe Dillon, Jr.", and above Item [57], insert: -- [74], *Attorney, Agent, or Firm* - W.F. Fasse, W. G. Fasse --.

Column 7,
Line 48, after "funnel", replace "(120," by -- (12), --.

Signed and Sealed this

Tenth Day of June, 2003

JAMES E. ROGAN
*Director of the United States Patent and Trademark Office*